US006663472B2

(12) United States Patent
Lim et al.

(10) Patent No.: US 6,663,472 B2
(45) Date of Patent: Dec. 16, 2003

(54) MULTIPLE STEP CMP POLISHING

(75) Inventors: Victor Seng-Keong Lim, Singapore (SG); Chen Feng, Singapore (SG); Subramanian Balakumar, Singapore (SG); Paul Proctor, Singapore (SG)

(73) Assignee: Chartered Semiconductor Manufacturing Ltd., Singapore (SG)

( * ) Notice: Subject to any disclaimer, the term of this patent is extended or adjusted under 35 U.S.C. 154(b) by 21 days.

(21) Appl. No.: 10/062,656

(22) Filed: Feb. 1, 2002

(65) Prior Publication Data

US 2003/0148712 A1 Aug. 7, 2003

(51) Int. Cl.[7] ..... B24B 5/08

(52) U.S. Cl. ..... 451/57; 451/41; 451/65; 451/285

(58) Field of Search ..... 451/50, 59, 57, 451/60, 63, 65, 285–289, 41

(56) References Cited

U.S. PATENT DOCUMENTS 3,841,031 A * 10/1974 Walsh ..... 451/41
5,503,592 A 4/1996 Neumann
5,899,745 A 5/1999 Kim et al.
5,951,380 A * 9/1999 Kim ..... 451/65
5,972,162 A * 10/1999 Cesna ..... 156/345.13
5,975,991 A * 11/1999 Karlsrud ..... 451/41
6,093,085 A 7/2000 Yellitz et al.
6,152,806 A * 11/2000 Nystrom ..... 451/36
6,248,006 B1 6/2001 Mukhopadhyay et al.
6,264,789 B1 7/2001 Pandey et al.

* cited by examiner

*Primary Examiner*—George Nguyen
(74) *Attorney, Agent, or Firm*—George O. Saile; Rosemary L. S. Pike

(57) ABSTRACT

An improved chemical mechanical polishing apparatus for planarizing semiconductor surface materials. The single rotating polishing platen with an attached pad of conventional CMP processes is replaced with two controlled independently driven, concentric and coplanar, polishing platens. The two co-planar polishing platens allows for separate adjustable options to the CMP polishing process. The options are provided by having pads of different material compositions and hardness. Moreover, an annular space is provided between the platens to introduce the usage of two slurry formulations, one to each pad, on the same CMP tool. The annular space between platens forming a drain path for catching and containing slurry waste.

12 Claims, 2 Drawing Sheets

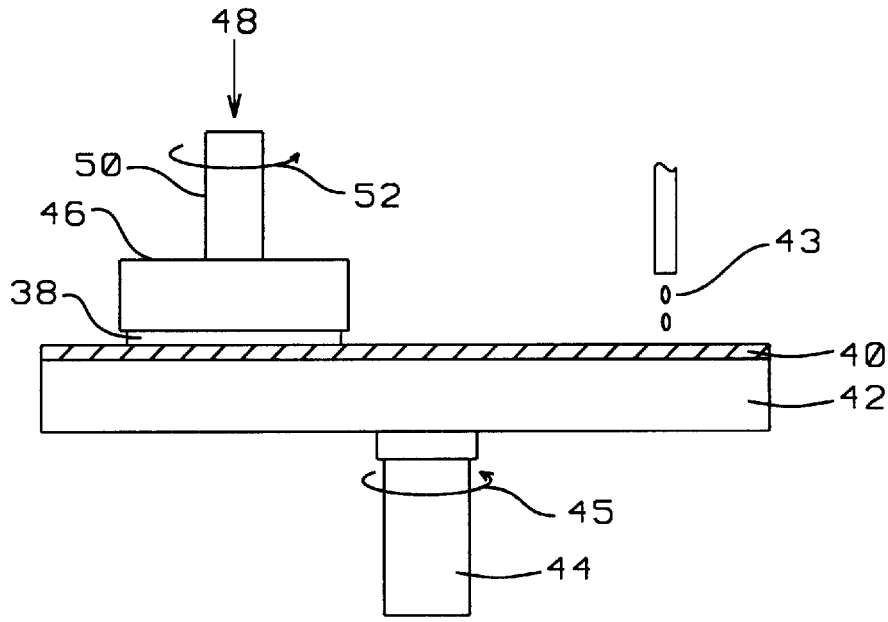
FIG. 1 – Prior Art
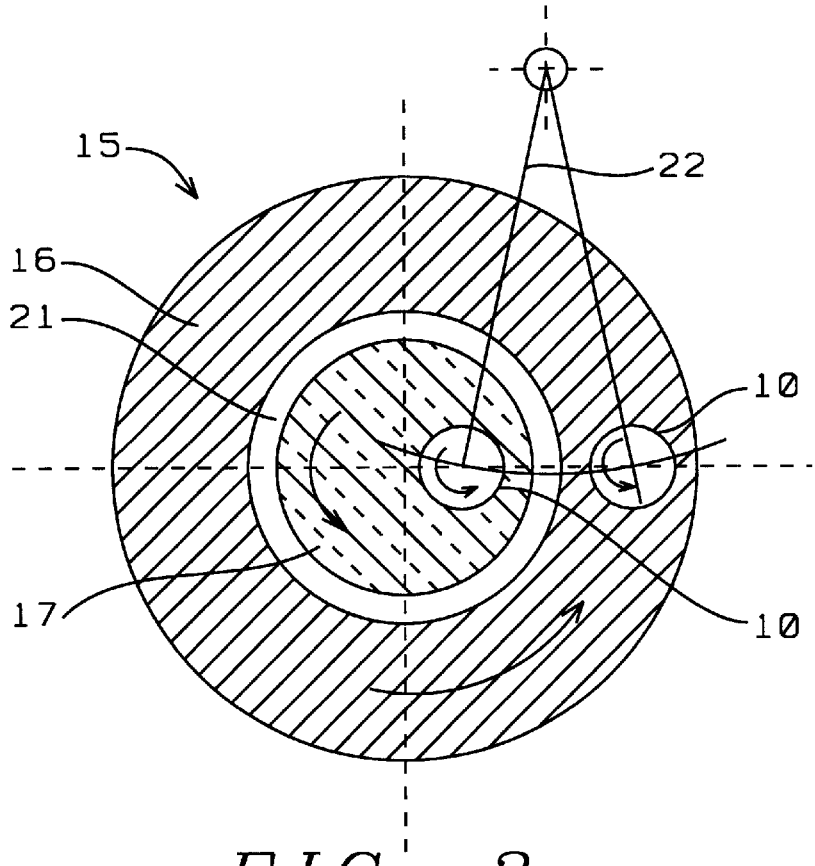
FIG. 2

MULTIPLE STEP CMP POLISHING

BACKGROUND OF THE INVENTION (1) Technical Field

This invention relates generally to an apparatus and method for planarizing semiconductor substrates during the manufacture of integrated circuits, and more particularly, to a polishing apparatus which facilitates the use of two distinct polishing slurries for a two-step chemical mechanical polishing process.

(2) Description of the Prior Art

The fabrication of integrated circuits on a semiconductor substrate involves the forming of a multiplicity of sequential layers involving a number of photolithographic process steps for each layer. The process forms window patterns in selected areas on the substrate, usually through a deposited insulating layer, for subsequent operations such as inclusion of impurities, oxidation, forming trenches, inlaying conductive metals, etc.

During the forming of the integrated circuit structures, it has become increasingly important to provide structures having multiple metallization layers due to the continuing miniaturization of the circuit elements in the structure. Each of the metal layers is typically separated from another metal layer by an insulation layer, such as an oxide layer. To enhance the quality of an overlying metal layer, one without discontinuities of other blemishes, it is imperative to provide an underlying surface for the metal layer that is ideally planar. The process of planarizing is now a standard process application of integrated circuit manufacturers.

To meet the needs for larger scale integration, which demands more metal and oxide layers in devices, the surface topography of the substrate must exhibit exact depth of focus for sub-micron lithography. Continued improvements in present polishing processes are essential. Chemical mechanical polishing (CMP) was developed and is presently used by most major semiconductor manufacturers. CMP is a method of polishing materials, such as semiconductor substrates and precision optical components, to a high degree of planarity and uniformity. The process is used to initially planarize semiconductor slices and is also used to remove uneven topography created during the forming of the sub-micron circuitry on the substrate. Where the substrate is to be further processed, such as by photolithographic etching to create integrated circuit structures, any thickness variation in the planarized layer makes it extremely difficult to meet the fine resolution tolerances required to provide high yield of functional die on a substrate.

A conventional CMP process involves supporting and holding the substrate against a rotating polishing pad that is wet with a polishing slurry and at the same time applying a pressure against the rotating pad. The pH of the polishing slurry controls the chemical reaction, for example, the oxidation of the chemicals that make up the insulating layer of the substrate. The polishing pad is typically made from non-fibrous polyurethane or a polyester-based material. The hardness is typically about between 50 and 70 durometer. Polishing pads used with semiconductors are commercially available in a woven polyurethane material. The polishing slurry, which includes an abrasive material, is maintained on the polishing pad to modify the polishing characteristics of the pad in order to enhance the polishing and planarization of the substrate. Although CMP planarization is effective, one recurring problem with CMP processing is the tendency of the process to differentially polish the surface of the substrate and thereby create localized over-polished and under-polished areas across the substrate surface. The difficulty in maintaining a high degree of planarity and uniformity is to control the oxide and metal removal rate constant across the top surface of the substrate as well as preserve a constant oxide removal rate from one substrate to the next, when the substrates are processed in succession.

Layers containing inlaid copper lines frequently show damage after CMP and cleaning. This causes problems with planarization of subsequent layers that are deposited over the damaged copper lines since these layers may now be deposited on a surface with uneven surface imperfections. To circumvent this problem, and to achieve a higher degree of planarization, two or more additional steps may be considered necessary. That is, after the first step, a second polishing would be done using a second CMP tool with preset and distinctive process parameters. These may include different rotation speeds of the polishing platen, and/or a variation in the polishing pressure applied to the substrate, and/or a different slurry formulation, also a different time cycle. Moreover, a third step may be needed to achieve the end result, that is, the substrate may need to be handled again and possibly finished on the first CMP tool. The added steps require excessive substrate handling, and process times.

FIG. 1 shows a Prior Art CMP tool illustrating the arrangement of a chemical mechanical polishing platen used for planarizing a top surface topology of a semiconductor substrate. A polishing pad 40 of a porous material is attached to the upper surface of a polishing platen 42. The polishing platen is horizontally supported by a platen-rotating shaft 44, and is rotationally driven, as indicated by the arrow 45, through the platen-rotating shaft 44 during the polishing operation. A polishing head 46 having a lower surface opposed to the upper surface of the polishing pad 40 on the polishing platen 42. The lower surface holds a substrate 38 to be polished. An elastomeric material (not shown) having cohesive properties is used on the bottom surface of the polishing head 46 to adhere and hold the substrate 38 to the polishing head. The polishing head 46 is mounted to a rotating shaft 50 and is rotationally driven by the rotating shaft. A slurry 43 is deposited on the polishing pad 40 and carried under the substrate 38 for polishing. The substrate-polishing head 46 also rotates as indicated by arrow 52, usually in the same direction as the polishing platen 42 at about between 1 to 100 rpm. Because of the rotation of the polishing platen 42, the substrate 38 traverses a circular path over the polishing pad 40. A force 48 is also applied in the downward vertical direction against substrate 38 and presses the substrate 38 against the polishing pad 40 as it is being polished. The force is typically in the order of between 0 and 15 psi and is applied by means of the rotating shaft 50 that is attached to the back of substrate polishing head 46.

SUMMARY OF THE INVENTION

It is therefore a primary object of the present invention to provide a single polishing tool that can improve the uniformity and planarity of the plane of the surface of a substrate being polished.

It is another object of the present invention to provide the means to complete two, or more CMP processes, consecutively as needed, on the same CMP tool.

It is another object of the present invention to provide a CMP polishing tool that reduces the overall handling of the substrate, thereby, reducing CMP process time and number of CMP tools required.

In accordance with the objectives of the present invention, a new CMP tool configuration is provided that improves the planarity of semiconductor surfaces. The single polishing platen of conventional CMP tools is divided into two co-planar arranged platens, each having independent rotational drives and controls. The platens having upper surfaces on which two different polishing pads are attached, for example, the outer most coaxial platen with a first slurry recipe to best planarize, for example, inlaid metal, while the inner pad would be used to polish the insulating layer using a second slurry recipe. The major contributions of this invention is the ability to use one CMP tool for two or more consecutive process steps, and implementing different slurry formulations on the same CMP tool. An annular separation between the coaxial and planar polishing surfaces allows usage of different slurry formulations. The intended separation segregates the slurries and permits drainage to be collected below the rotating platens.

A rotating substrate support spindle having a lower surface opposed to an upper surface of the polishing pad. The substrate support spindle holds a substrate to be polished on the lower surface while applying pressurizing means to the rotating substrate towards the polishing pads to perform a specific CMP operation to the topography of the substrate. The improvement in which the rotating substrate can be traversed from an outer polishing platen, completing a first CMP operation to an inner rotating polishing plate to perform a second CMP operation, and if needed, back to the outer platen, and etc.

DESCRIPTION OF THE DRAWINGS

FIG. 1 is a schematic front view of a CMP apparatus according to the prior art.

FIG. 2 shows a top view of a CMP concentric polishing platen of the invention.

DESCRIPTION OF THE PREFERRED EMBODIMENT

Figure 3:
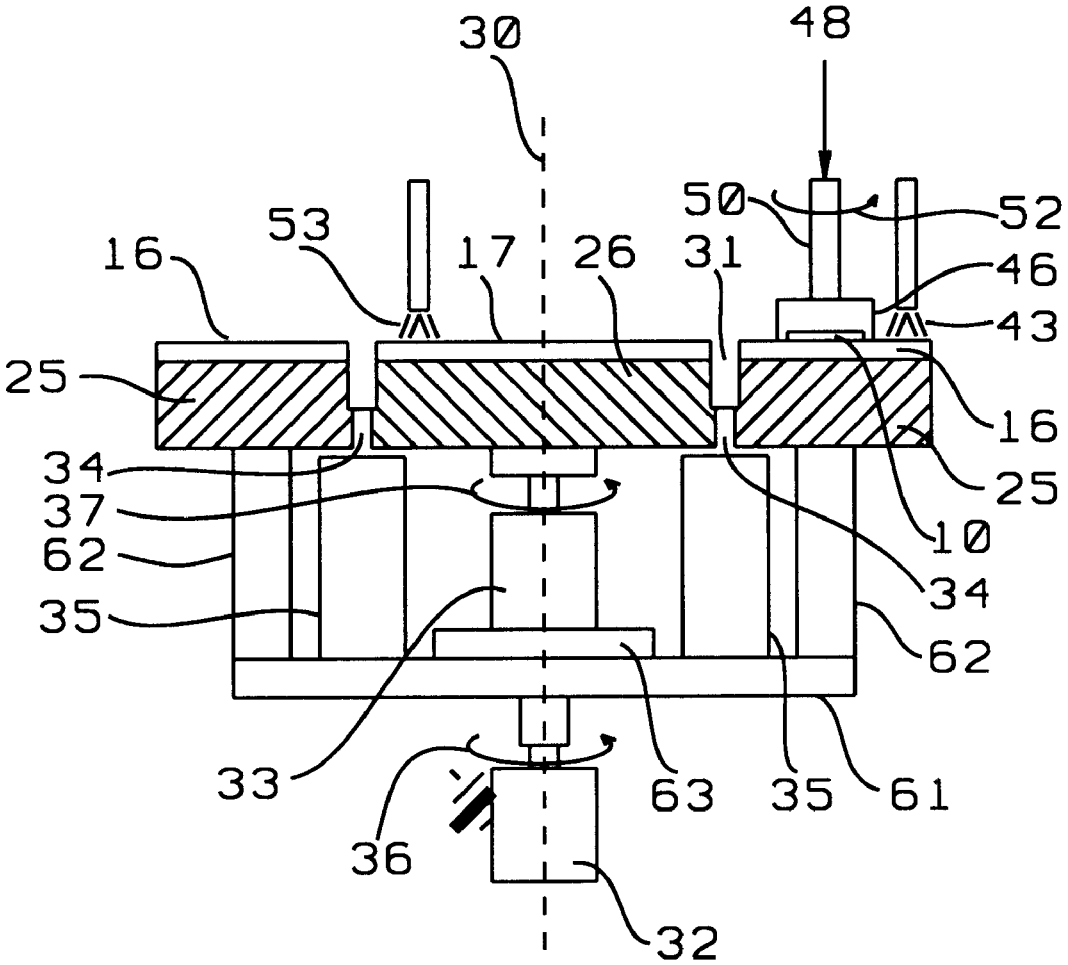
FIG. 3 is a schematic front sectional view of a concentric CMP polishing platen of the invention.

There will now be described in detail with reference to the drawings some preferred embodiments of the present invention applied to a chemical mechanical polishing tool for planarizing of a semiconductor substrate. In the following description of the preferred embodiments, the same reference numerals as those in the prior art denote similar parts for convenience of illustration Referring now specifically to FIGS. 2 and 3 illustrating a CMP concentric polishing platen 15, of the invention. The typical single polishing pad is divided into two pads 16 and 17, concentrically mounted on the top co-planar surfaces of platens 25 and 26, each separated by an annular space 21. This annular space provides a drainage path 34 for different polishing slurries that may be used, in close proximity, on polishing pads 16 and 17. A particular slurry recipe could be dispensed on the outer pad 16 to best planarize, for example, inlaid metal conductors, while the inner polishing pad may be dedicated to planarizing TaN (where the TaN is used as the barrier layer of an inlaid structure). The run-off is collected in containment means 35.

The major contributions of this invention are: The ability to use one CMP tool with one polishing head to execute two or more consecutive process steps, while using different slurry formulations on the same CMP tool.

The two platens are independently and differentially controlled and driven about the same central axis 30. Platform 61 supporting the outer platen 25, on which polishing pad 16 is attached, is held up by a multiplicity of vertical extension members 62. The outer platen 25 is rotatably driven by motor 32 in the direction shown by arrow 37. The inner platen 26 on which polishing pad 17 is attached, is rotatably driven by both motors 32 and 33 since motor 33 is centrally mounted on platform 61 by motor flange 63. This tandem arrangement provides independent controls between each platen; for example, the rotation of the inner platen 26 can be increased or decreased relative to the rotation speed of the outer platen 25. If an increase of the inner platen rotation were needed, its motor speed would be increased in the rotational direction of motor 32. Conversely, if a slower rotation of the inner platen were required, a reverse rotation of motor 33 relative to the rotational direction of motor 32 would be made. The rotational speeds of both motors are variable. This gives the CMP process a wide range of options. Moreover, the two pads may differ in material composition and hardness and a different slurry recipe can be applied to each polishing pad. The options provided allows, for example, polishing pad 16 may be dedicated to planarizing copper, while the inner polishing pad may be dedicated to planarizing TaN (where the TaN is used as the barrier layer of an inlaid structure).

Referring now more specifically to FIG. 2, a rotation distance of 22 is shown to designate the path that substrate 10 is moved by a polishing head (not shown), between co-planar pads 16 and 17.

The variations available for choosing a particular combination of polishing pads, slurries and rotational speeds provides the device manufacturer with the capability of performing multiple operations on a single CMP tool. The benefits provided by this tool configuration are obvious in terms of substrate handling, number of CMP tools required and process consistency.

A polishing head 46 having a lower surface opposed to the upper surface of the polishing pads 16 and 17 mounted to the co-planar polishing platen 25 and 26. The lower surface of the polishing head 46 holds a substrate 10 to be polished. An elastomeric material (not shown) having cohesive properties, and vacuum, is applied on the bottom surface of the polishing head 46 to adhere and hold the substrate 10 to the polishing head. The polishing head 46 is mounted to a rotating shaft 50 and is rotationally driven by the rotating shaft. Two slurry formulations 43 and 53 are deposited on polishing pads 16 and 17 respectfully, and carried under the substrate 10 during polishing. As mentioned earlier, an annular space 31 forms a drainage path and leads the excess slurry run-off waste in drains 34 and into containment vessels 62. The substrate polishing head 46 rotates as indicated by arrow 52, usually in the same direction as the polishing platens 25 and 26, at about between 1 to 100 rpm. Because of the rotation of the polishing platens, the substrate 10 traverses a circular path over the polishing pad. A force 48 is applied in the downward vertical direction against substrate 10 and presses the substrate against the polishing pads as it is being polished. The force is typically in the order of between 0 and 15 psi and is applied by means of the rotating shaft 50 that is attached to the back of substrate head 46.

While the invention has been particularly shown and described with reference to the preferred embodiments thereof, it will be understood by those skilled in the art that various changes in form and details may be made without departing from the spirit and scope of the invention.

What is claimed is:

1. A chemical mechanical polishing apparatus for planarizing semiconductor substrates, comprising:

two concentric and coplanar rotatable platens with detachable polishing pad for separately supporting semiconductor substrates;

said concentric and coplanar platens cover radial distances greater than the outside dimensions of said substrate being processed.

a means for distributing two kinds of polishing slurries, one to each polishing pad;

an annular gap between said polishing platens for preventing cross contamination from one polishing platen to the other;

a differential drive arrangement for independently controlling the rotation of each of said concentric polishing platens, said differential drive arrangement includes a controllable primary drive that is coupled to rotate both concentric polishing platens, with a piggy-back secondary drive that is coupled to the inner most platen, said secondary drive is used to controllably add to or to subtract from the rotation of said inner most platen;

a means for controlling an applied pressure to said substrate during polishing.

2. The apparatus of claim 1 wherein said detachable polishing pads are mounted to conform to the shape of each platen with an option of choosing polishing pads that differ in hardness and material composition.

3. The apparatus of claim 2 wherein each polishing pad is chosen to enhance the polishing of different inlaid and layered substrate materials.

4. The apparatus of claim 1 wherein specific polishing slurry distributed to each polishing pad is determined by the substrate topology and material being polished.

5. The apparatus of claim 1 wherein said annular gap between said concentric polishing platens forms a drainage path for excess slurry to a collection container positioned thereunder.

6. The apparatus of claim 1 wherein said two concentric polishing platens provides the user with one CMP tool to perform two or more consecutive process steps while implementing different slurry formulations on two different polishing pads.

7. A chemical mechanical polishing method for planarizing semiconductor substrates, comprising the steps of:

providing two concentric and coplanar rotatable platens with detachable polishing pads for supporting semiconductor substrates;

said concentric and coplanar platens cover radial distances greater than the outside dimensions of said semiconductor substrate;

providing a means for distributing two kinds of polishing slurries, one to each polishing pad;

providing an annular gap between said polishing platens for preventing cross contamination from one polishing platen to the other;

providing a differential drive arrangement for independently controlling the rotation of each of said concentric polishing platens, said differential drive arrangement includes a controllable primary drive that is coupled to rotate both concentric polishing platens, with a piggy-back secondary drive that is coupled to the inner most platen, said secondary drive is used to controllably add to or to subtract from the rotation of said inner most platen;

providing a means for controlling an applied pressure to said substrate during polishing.

8. The method of claim 7 wherein said detachable polishing pads are mounted to conform to the shape of each platen with an option of choosing polishing pads that differ in hardness and material composition.

9. The method of claim 8 wherein each polishing pad is chosen to enhance the polishing of different inlaid and layered substrate materials.

10. The method of claim 7 wherein a specific polishing slurry distributed to each polishing pad is determined by the substrate topology and material being polished.

11. The method of claim 7 wherein said annular gap between said concentric polishing platens forms a drainage path for excess slurry to a collection container positioned thereunder.

12. The apparatus of claim 7 wherein said two concentric polishing platens provides the user with one CMP tool to perform two or more consecutive process steps while implementing different slurry formulations on two different polishing pads.

* * * * *